US007219674B1

(12) United States Patent
Shelley

(10) Patent No.: US 7,219,674 B1
(45) Date of Patent: May 22, 2007

(54) TEMPLATE AND METHOD FOR APPLYING MAKEUP TO EYEBROWS

(76) Inventor: Deborah Shelley, 43 Branch Brook Pl., Newark, NJ (US) 07104

( * ) Notice: Subject to any disclaimer, the term of this patent is extended or adjusted under 35 U.S.C. 154(b) by 166 days.

(21) Appl. No.: 10/801,302

(22) Filed: Mar. 17, 2004

(51) Int. Cl.
*A45D 40/30* (2006.01)

(52) U.S. Cl. ..... 132/319; 132/216

(58) Field of Classification Search ..... 132/319, 132/320, 285, 216; 2/9, 206, 174, 12, 13; 351/59; 33/562, 512
See application file for complete search history.

(56) References Cited

U.S. PATENT DOCUMENTS

| | | | | |
|---|---|---|---|---|
| 1,566,661 | A | 12/1925 | Essig | |
| 1,812,425 | A * | 6/1931 | Gerd | 132/216 |
| 1,962,818 | A * | 6/1934 | Hoffman | 2/12 |
| 2,197,973 | A * | 4/1940 | Everett et al. | 2/13 |
| 2,233,698 | A * | 3/1941 | Girouard | 2/206 |
| 3,300,864 | A | 1/1967 | Lesslie | |
| 3,718,145 | A * | 2/1973 | Chateall | 132/216 |
| 4,118,870 | A | 10/1978 | Dyson | 33/174 |
| D291,607 | S | 8/1987 | Flores | D28/7 |
| 5,186,190 | A | 2/1993 | Hirzel | 132/319 |
| 5,416,923 | A * | 5/1995 | Peugh | 2/9 |
| 5,662,129 | A | 9/1997 | Grenevitch et al. | 132/319 |
| 5,860,433 | A | 1/1999 | Halpern | 132/319 |
| 5,939,142 | A * | 8/1999 | Comiskey et al. | 427/256 |
| 6,109,921 | A | 8/2000 | Yau | 434/100 |
| 6,336,462 | B1 | 1/2002 | Santelli et al. | 132/319 |
| 6,957,142 | B2 * | 10/2005 | Entenmann | 701/117 |
| 2003/0015214 | A1 | 1/2003 | Faragi | 132/320 |
| 2003/0234028 | A1 | 12/2003 | Edell | 132/319 |
| 2004/0231694 | A1 * | 11/2004 | Rosenblatt | 132/319 |

FOREIGN PATENT DOCUMENTS

| | | | |
|---|---|---|---|
| JP | 09028458 | A * | 2/1997 |
| JP | 10108730 | A * | 4/1998 |

* cited by examiner

*Primary Examiner*—Robyn Doan
(74) *Attorney, Agent, or Firm*—Thomas L. Adams

(57) ABSTRACT

An eyebrow template can be used to apply makeup to a person's eyebrows. The template has a saddle that is shaped to be placed against the bridge of the person's nose. The template also has a pair of guides each attached to the saddle and each having a guide opening for guiding the application of makeup to the person's eyebrows. After placing the saddle against the bridge of the person's nose the templates are adjusted to outline the person's eyebrows. Then makeup is applied to the person's eyebrows using the templates to guide the makeup application.

14 Claims, 3 Drawing Sheets

TEMPLATE AND METHOD FOR APPLYING MAKEUP TO EYEBROWS

BACKGROUND OF THE INVENTION

1. Field of the Invention

The present invention relates to templates for guiding the application of makeup onto eyebrows.

2. Description of Related Art

Correctly applying makeup to the eyebrows with an eyebrow pencil or other device requires a great deal of skill. Often the eyebrow makeup will be applied to give the eyebrow a different shape or appearance. Relatively short eyebrows can be made to appear longer; thin eyebrows can be made to appear thicker; eyebrows with a non-distinctive shape can be given a very dramatic flair, and so forth. Creating these special appearances not only requires some artistic talent, but also demands high precision because the human eye will quickly notice small differences between a pair of eyebrows. Accordingly, there have been many attempts in the past to produce a satisfactory template that can conveniently and effectively guide the application of makeup to eyebrows.

Conventional stencils can be adhesively secured around a person's eyebrows. Adhesives are generally inconvenient, but even if the template is held in place by hand, this reduces the room available for the other hand that is applying makeup to the eyebrow. See U.S. Pat. Nos. 5,860,433 and 6,336,462; and U.S. Patent Application Publication No. 2003/00234028.

Some eyebrow stencils are held in place with a headband. A headband can muss a hairdo and is rather awkward and embarrassing to use in a restaurant's restroom or other public facility. See U.S. Pat. Nos. 3,718,145; 5,186,190 and 5,662,129.

U.S. Design Patent 291,607 shows a tree-like structure, but its usefulness as an eyebrow template is unclear.

In U.S. Pat. No. 4,118,870 an eyebrow guide has an arm 21 that can be adjusted with two degrees of freedom in order to set the height and angle of the eyebrow contour guide. However, arm 21 will cover one eye. Also, this guide cannot be conveniently used to fix the guide with relation to the person's face since it is free to move relative to the face.

See also U.S. Pat. Nos. 3,300,864 and 1,566,661; and U.S. Patent Application Publication No. 2003/0015214.

Accordingly, there is a need for an improved device that will guide the application of makeup to eyebrows in an effective and efficient manner.

SUMMARY OF THE INVENTION

In accordance with the illustrative embodiments demonstrating features and advantages of the present invention, there is provided an eyebrow template for applying makeup to a person's eyebrows. The template has a saddle that is shaped to be placed against the bridge of the person's nose. The template also has a pair of guides each attached to the saddle and each having a guide opening for guiding the application of makeup to the person's eyebrows.

In accordance with another aspect of the invention, a method employing a pair of templates attached by stems to a saddle is performed in order to apply makeup to a person's eyebrows. The method includes the step of placing the saddle against the bridge of the person's nose with the templates outlining the person's eyebrows. Another step is applying makeup to the person's eyebrows using the templates to guide makeup application.

By employing devices and methods of the foregoing type, one is able to conveniently and effectively apply makeup to eyebrows. In a preferred embodiment a curved saddle is designed to lay on the bridge of the person's nose. Stems extending from the saddle can support a pair of templates preferably in the form of loops. The preferred stems are flexible to allow adjustment of the templates relative to the person's eyebrows. On the other hand, the preferred loops are themselves designed to allow some flexing to accommodate the curvature of the forehead, but have a structure that essentially prevents alterations to the size of the opening in the loop to prevent changing the shape that will be applied by the template.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Referring to FIGS. 1–5 the illustrated eyebrow template has a saddle 10 that is designed to fit around the bridge of the nose of a person P. Saddle 10 is shown with a shape that is downwardly flared. The shape of saddle 10 may be rather complex to agree with the average anatomy, but may be generally described as a frustoconical section that extends about 180°. In some embodiments saddle 10 may be 0.25 to 1.0 inch (0.6 to 2.5 cm) tall.

Preferably, saddle 10 may be a soft plastic that does not irritate the person's skin. While in some embodiments saddle 10 may be somewhat flexible and springy in order to clip to the bridge of a person's nose, such clipping is unnecessary. In fact, in most embodiments, saddle 10 will simply be held in place with one of the person's fingers. In some embodiments saddle 10 will be formed from a curved metal band that is coated with a soft plastic, epoxy, or other material.

Integrally connected to saddle 10 are a pair of stems 12. Stems 12 initially slant inwardly along converging proximal sections 12A to follow the outline of the bridge of the person's nose. From there stems 12 slant outwardly along diverging distal sections 12B.

Figure 5:
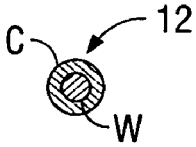
FIG. 5 is a cross-sectional view taken along line 5—5 of FIG. 2.

In some embodiments stems 12 will be plastic coated wires. FIG. 5 shows stem 12 having a wire W with plastic coating C. Wire W will enable one to readily bend the stems 12 to adjust the present device.

In other embodiments, the stems 12 may be continuous plastic (no wire core) integrally molded with saddle 10 and made of a single plastic material that will give saddle 10 and stems 12 the appropriate flexibility. In still other embodiments the device can be made from a mold that allows injection of different types of materials so that saddle 10 and stems 12 will be made of different plastics.

Figure 1:
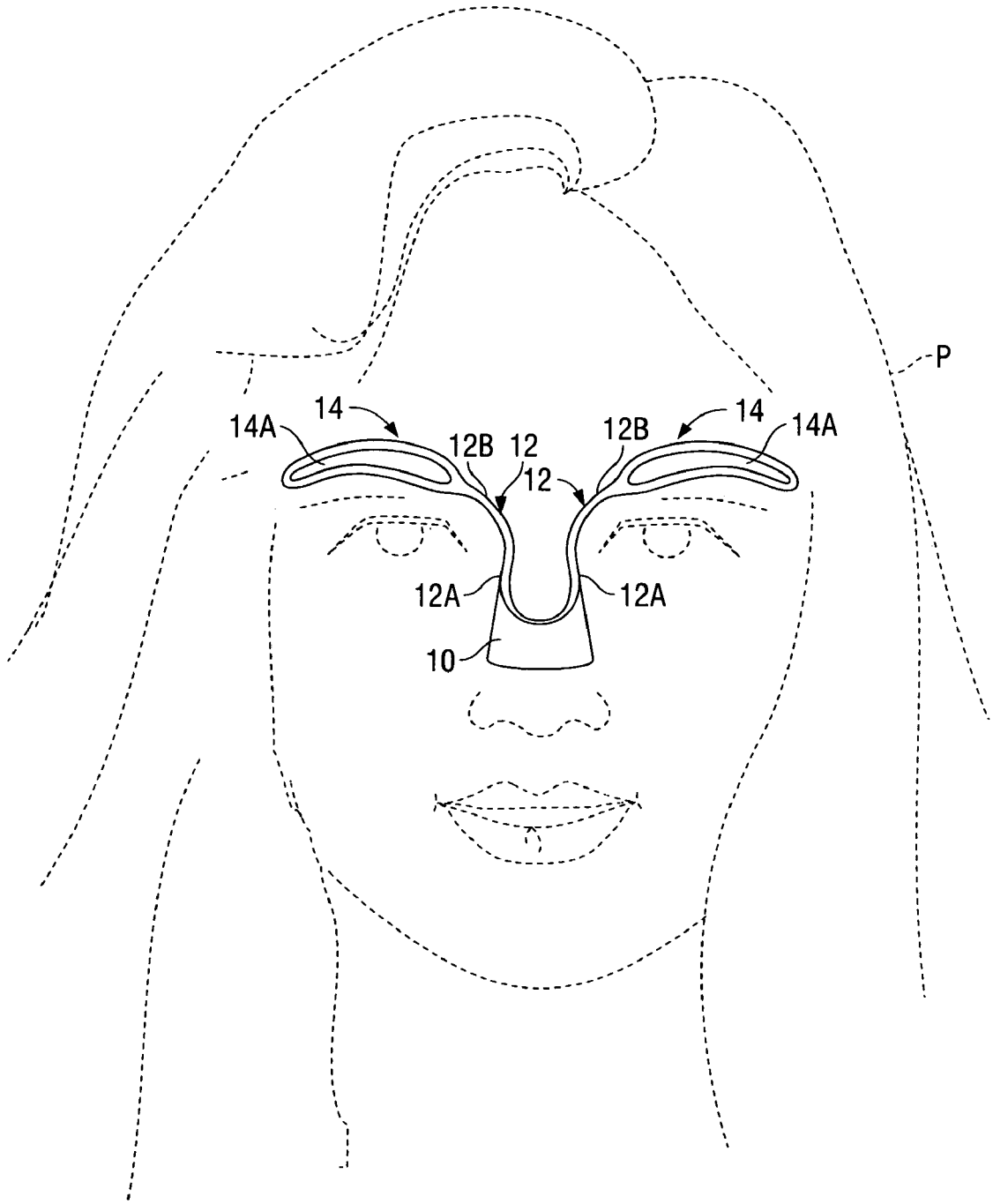
FIG. 1 is a perspective view of a template structured and used in accordance with principles of the present invention.
Figure 2:
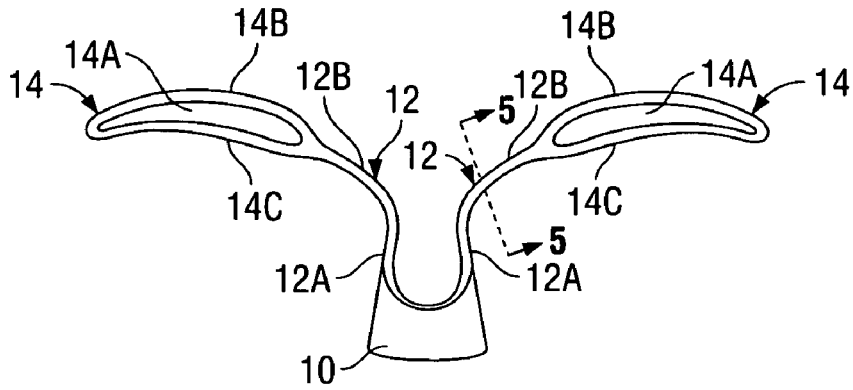
FIG. 2 is a front elevational view of the template of FIG. 1.
Figure 3:
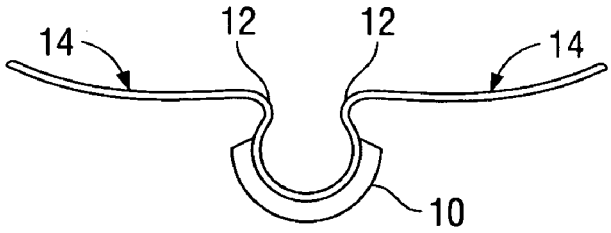
FIG. 3 is a top view of the template of FIG. 1.
Figure 4:
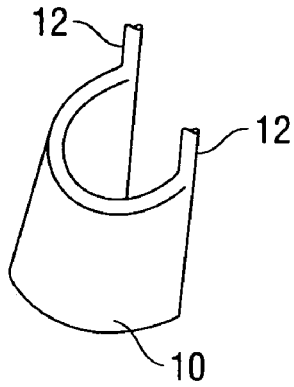
FIG. 4 is a detailed fragmentary view of the saddle of the template of FIG. 1.

Stems 12 support the guides 14, shown herein in the form of elongated loops. The guides 14 have guide openings 14A that are designed to act as a template for applying makeup to a person's eyebrows. As shown in FIG. 3, guides 14 curve to follow the shape of the person's forehead. As shown in FIG. 2, the guides 14 have convex upper edges 14B and concave lower edges 14C, generally following the normal curvature of the person's eyebrows.

Since the guides 14 have a loop-like shape they are relatively compact. In preferred embodiments the guides 14 will be at most 2 cm tall. It is much preferred that the guide openings 14A maintain the same size even if guides 14 are flexed by the user to follow the curvature around a person's forehead. In some embodiments the size of the guide openings 14A is maintained by making guide 14 of relatively stiff or relatively thick material. In some instances the guide 14 may be molded with a different plastic material than stem 12. In other embodiments guide 14 may be made from a sheet metal stamping that is then coated with plastic. Such a sheet metal stamping will allow the guide 14 to flex around the forehead but will not allow alteration of the size of the guide opening 14A. Embodiments employing a sheet metal stamping may be welded to the wire core of the stems 12 as applicable.

It will be appreciated, however, that in some embodiments the illustrated device will not have a metal core in any of its components and will be molded from a single plastic material (or in some cases from multiple plastic materials). Also, in some embodiments saddle 10, stems 12, and guides 14 may be manufactured separately and then secured together by gluing, by welding, by mortise and tenon joints, etc.

Figure 6:
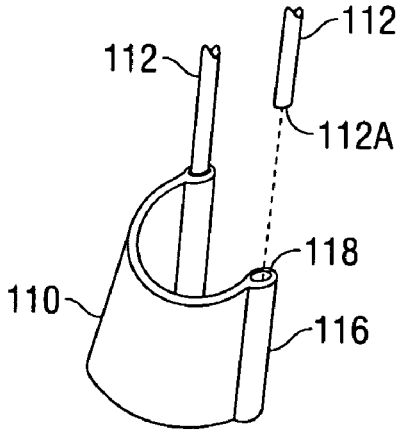
FIG. 6 is a detailed fragmentary view of a saddle and stems that is an alternate of that of FIG. 6.
Figure 7A:
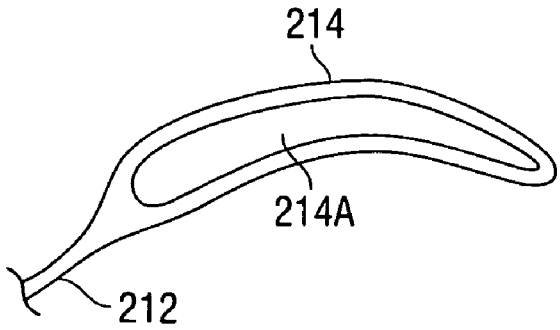
FIGS. 7A–7D are front views of guides that are alternates to that of FIG. 1.
Figure 7B:
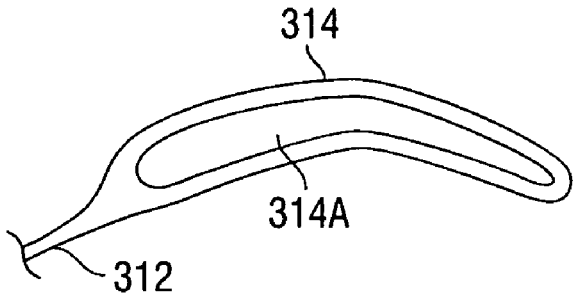
Figure 7C:
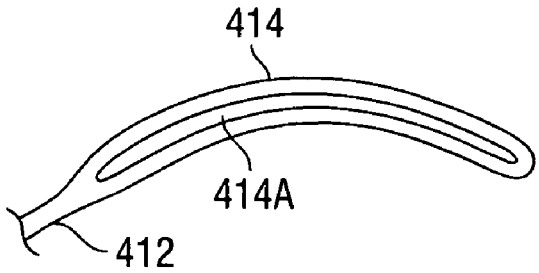
Figure 7D:
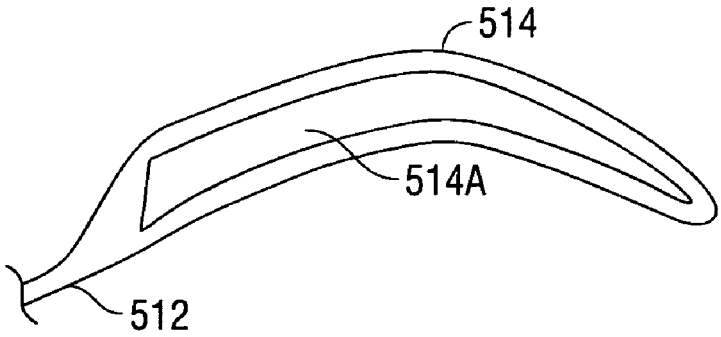

Referring to FIG. 6, the separate saddle 110 is shown with a pair of cylindrical columns 116 having on top the sockets 118. The sockets 118 are designed to receive and hold the tips 112A of stems 112. The outer portions of stems 112 can be the same as the stems shown in FIG. 1 and may terminate in the guides 14, also shown in FIG. 1. The advantage with the design of FIG. 6 is that the guides associated with stems 112 can have different shapes so that the user can apply makeup in different styles.

Referring to FIGS. 7A–7D, examples of various eyebrow styles are given for the previously mentioned guides. For example, the guide 214 of FIG. 7A (supported by stem 212) offers a bold design wherein guide opening 214A outlines a thick eyebrow with a well-defined arch. The guide 314 of FIG. 7B (supported by stem 312) offers an easy design wherein guide opening 214A outlines a moderately sized eyebrow with a gentle arch. The guide 414 of FIG. 7C (supported by stem 412) offers a slim design wherein guide opening 414A outlines a thin eyebrow with a simply curved arch. The guide 514 of FIG. 7A (supported by stem 512) offers a long design wherein guide opening 514A outlines a long, thick, angular eyebrow with a well-defined arch.

The guides of FIGS. 7A–7D may be a set of replacement guides that are separate from the previously mentioned saddle. In particular, these guides may be supplied in pairs of right and left guides with stems having tips that can plug into sockets as shown in FIG. 6.

To facilitate an understanding of the principles associated with the foregoing apparatus, its operation will be briefly described. The template of FIG. 1 can be positioned with the saddle 10 placed against the bridge of the person's nose. While saddle 10 can operate as a clip, preferably saddle 10 will simply be held in place with one of the fingers of the person P or another person who is applying makeup to person P. Once in position, the user can adjust the position of guides 14 by taking advantage of the flexibility of stems 12. In embodiments where stems 12 are plastic-coated wires, the wires will have a certain flexibility and will be relatively soft so that they can be bent into a position that will then remain static. In particular, the height and angle of guides 14 can be adjusted to align with the person's eyebrows. It will be noted that the alignment can altered from exact alignment in the event that one desires to change the angular orientation or position of the person's natural eyebrows.

It will be appreciated that in some instances emphasis will be placed on applying the makeup to the eyebrows symmetrically. In those instances the stems 12 may be made relatively inflexible to enforce symmetry. In other embodiments, the plastic of the guides can be heat treated to allow initial adjustment but then turning rigid maintain symmetry. For example, the stems 12 can be supplied in a relatively flexible condition. However on heating, the stems 12 will become relatively rigid. Alternatively, the stems can be supplied relatively rigid but can be heated and softened so that they are pliable for a brief period of time while the guide position is being adjusted. This heat can be applied by a hairdryer, or by placing the device in hot water.

In any event, once the guide position is established, a hand other than the one holding saddle 10, can be used to apply makeup to an eyebrow with, for example, an eyebrow pencil.

An advantage of the foregoing device is that it is relatively compact and discrete. Thus a person may accurately apply eyebrow makeup using the mirror of a restaurant's bathroom without drawing attention. Moreover, the compact nature of the device allows easy storage in a purse, pocket etc.

It will be appreciated that various modifications may be implemented with respect to the above described, preferred embodiments. For example, the size and shape of the various components can be altered depending upon the desired portability, strength, makeup effect, etc. Also, the template can be formed by molding, stamping, machining, etc. In addition, the template can be formed of several separate components that can be joined at various locations. Furthermore, the relative heights of the saddle and stems can be changed by allowing them to extend over various percentages of the distance from the bridge of the person's nose to the eyebrows. Moreover, in some embodiments the guides can be replaceable as a single unit that is integrated into a generally V-shaped item that connects to a saddle. Also, the replaceable guides can connect to the saddle using a socket formed in either the saddle or the guide or by other connection means. In addition, the illustrated guides and stems can be designed with a fluid transition that is not distinct, but is a relatively gradual transition.

Obviously, many modifications and variations of the present invention are possible in light of the above teachings. It is therefore to be understood that within the scope of the appended claims, the invention may be practiced otherwise than as specifically described.

The invention claimed is:

1. An eyebrow template for applying makeup to a person's eyebrows, comprising:

a saddle that is shaped to be placed against the person's nose, said saddle having a spaced pair of sockets;

a pair of guides each attached to said saddle and each having a guide opening for guiding the application of makeup to the person's eyebrows, said guides branching laterally and said saddle branching downwardly and transversely to said guides; and a pair of stems each connecting a corresponding one of said guides to said saddle, said stems each having a tip sized to be replaceably inserted in one of said sockets.

2. An eyebrow template according to claim 1 wherein said pair of stems is flexible to allow spatial adjustment of said pair of guides.

3. An eyebrow template according to claim 1 wherein said pair of stems have converging proximal sections and diverging distal sections.

4. An eyebrow template according to claim 1 wherein said saddle is downwardly flared to have a larger opening width below.

5. An eyebrow template according to claim 1 wherein said guides are elongated loops.

6. An eyebrow template according to claim 5 wherein said loops each has a convex upper edge and a concave lower edge.

7. An eyebrow template according to claim 6 wherein said loops are at most 2 cm tall.

8. An eyebrow template according to claim 1 wherein said guides are structured to prevent a distortion of the guide openings that would alter the size of the guide openings.

9. An eyebrow template according to claim 8 wherein said guides are flexible to curve around the person's forehead without altering the size of the guide openings.

10. An eyebrow template according to claim 1 wherein said stems have a different material composition than said guides.

11. An eyebrow template according to claim 10 wherein said stems each has a plastic coated wire.

12. An eyebrow template according to claim 11 wherein said guides each has a plastic coated piece of sheet metal.

13. An eyebrow template according to claim 1 comprising:

a plurality of replacement guides having replaceable stems with a replacement tip sized to be replaceably inserted in one of said sockets of said saddle, said replacement guides having various styles of guide openings.

14. An eyebrow template for applying makeup to a person's eyebrows, comprising:

a saddle that is shaped to be placed against the bridge of the person's nose, said saddle being downwardly flared to have a larger opening width below, said saddle having a spaced pair of sockets;

a pair of guides each having a guide opening for guiding the application of makeup to the person's eyebrows, said guides being elongated loops each having a convex upper edge and a concave lower edge, said guides being flexible to curve around the person's forehead without altering the size of the guide openings, said loops being at most 2 cm tall;

a pair of stems for connecting said guides to said saddle, said stems each having a tip sized to be replaceably inserted in one of said sockets, said pair of stems being flexible to allow spatial adjustment of said pair of guides, said stems each having a plastic coated wire and having a different material composition than said guides; and a plurality of replacement guides having replaceable stems with a replacement tip sized to be replaceably inserted in one of said sockets of said saddle, said replacement guides having various styles of guide openings.

* * * * *